US006137978A

United States Patent [19]

Tsuchiya et al.

[11] Patent Number: 6,137,978

[45] Date of Patent: Oct. 24, 2000

[54] TONER REPLENISHING APPARATUS HAVING A PLURALITY OF SCRAPING MEMBERS OF DIFFERING CAPACITIES

[75] Inventors: Takahiro Tsuchiya; Isao Matsuoka; Hiroshi Fuma; Kenji Taki, all of Hachioji, Japan

[73] Assignee: Konica Corporation, Japan

[21] Appl. No.: 09/231,561

[22] Filed: Jan. 14, 1999

[30] Foreign Application Priority Data

Jan. 19, 1998 [JP] Japan ..... 10-007444

[51] Int. Cl.[7] ..... G03G 15/08; B67D 5/64

[52] U.S. Cl. ..... 399/258; 222/167

[58] Field of Search ..... 399/27, 227, 258, 399/260, 262, 263; 222/167

[56] References Cited

U.S. PATENT DOCUMENTS 5,142,325 8/1992 Kai et al. ..... 399/41
5,162,849 11/1992 Yoshino et al. ..... 399/256
5,220,382 6/1993 Hediger ..... 399/27
5,235,384 8/1993 Oka et al. ..... 399/27
5,253,020 10/1993 Matsushita et al. ..... 399/30
5,557,382 9/1996 Tatsumi et al. ..... 399/262
5,652,947 7/1997 Izumizaki ..... 399/58
5,717,973 2/1998 Endoh et al. ..... 399/29
5,765,079 6/1998 Yoshiki et al. ..... 399/258
5,826,134 10/1998 Hino et al. ..... 399/27
5,835,828 11/1998 Jyoroku ..... 399/256

*Primary Examiner*—Arthur T. Grimley
*Assistant Examiner*—Hoang Ngo
*Attorney, Agent, or Firm*—Jordan B. Bierman; Bierman, Muserlian and Lucas

[57] ABSTRACT

A toner replenishing apparatus includes: a toner reservoir section for reserving a toner therein; and scraper for scraping out the toner in the toner reservoir section and for supplying the toner to a developing device. The scraper is composed of a plurality of scraping members each having a different capability of scrape-out from each other.

5 Claims, 13 Drawing Sheets

TONER REPLENISHING APPARATUS HAVING A PLURALITY OF SCRAPING MEMBERS OF DIFFERING CAPACITIES

BACKGROUND OF THE INVENTION

The present invention relates to an improvement of a toner replenishing apparatus in an image forming apparatus in which an image is formed by an electrophotographic method.

Ordinarily, a toner replenishing apparatus to replenish toner is equipped in an image forming apparatus by an electrophotographic method, that is, an electrophotographic apparatus, so that an amount of toner consumed by image formation is replenished, thereby an image having an appropriate density is always formed. As such the toner replenishing apparatus, various type ones exist. As one of these apparatus, there is such type of apparatus that the toner stored in a toner storing section is scraped out and supplied to a developing unit. This type of apparatus is better than a type of apparatus, for example, in which toner is dropped from a toner replenishing port by the action of gravity and supplied to the developing unit, in the point that a supplying amount of toner is relatively easily and accurately controlled by controlling the operation of a toner scraping means for scraping out the toner.

The toner replenishing apparatus disclosed in Japanese Patent Publication Open to Public Inspection No. 48930/1998 is this type of replenishing apparatus, that is, the apparatus in which toner is scraped out of the toner storing section, conveyed, and replenished.

As described above, the type of toner replenishing apparatus in which toner is scraped out by the scraping means and conveyed, has an advantage that a replenishing amount or a replenishing rate can be relatively accurately controlled, and the advantage becomes specifically conspicuous when the remaining toner amount in the toner storing section becomes small.

Normally, a remaining toner amount detecting device is equipped in the toner replenishing apparatus, and when the remaining toner amount becomes small, it outputs an alarm signal to request the toner replenishment. However, it is inconvenient that the image forming apparatus is stopped at once when the alarm signal is outputted, but it is more convenient that the image can still be formed even when the alarm signal is outputted, because the operator can have sufficient time necessary for installing a new toner container into the toner replenishing apparatus.

However, the conventional toner replenishing apparatus having the scraping means as described above, is not yet satisfactory for making the image forming apparatus continue image forming operations for some time when the remaining amount of toner becomes small. That is, when the remaining amount of toner becomes small, a toner replenishing signal is outputted from a remaining toner amount detecting device. When the toner replenishing signal has been outputted, the toner replenishing amount is too quickly decreased, so that the image forming apparatus can not have sufficient time for installing a new container, thereby, the image quality is extremely deteriorated, and the image forming apparatus is stopped by detecting the image deterioration, etc., resulting in unstable operations of the image forming apparatus, which is a problem.

SUMMARY OF THE INVENTION

Accordingly, an object of the present invention is to solve the above-described problems, and to provide a toner replenishing apparatus by which advantages of the toner replenishing apparatus provided with a scraping means can be fully utilized.

The above cited object of the present invention is achieved by a toner replenishing apparatus in which toner is scraped out of a toner storing section in which the toner is stored, and supplied to a developing unit, the toner replenishing apparatus is characterized in that the toner scraping means is structured by a plurality of scraping members having scraping capacity different from each other.

DETAILED DESCRIPTION OF THE PREFERRED EMBODIMENT

(1) Image Forming Apparatus

Prior to the description of an example of the present invention, referring to a sectional view in FIG. 1, a structure and operations of a color printer of an example of a color image forming apparatus in which a plurality of toner replenishing apparatus of the present invention are mounted, will be described below.

This color printer is a color image forming apparatus of a type in which, after toner images of each color successively formed on an image forming body are superimposed, these images are transferred onto a recording material in a transfer section at one time and a color transfer image is formed, and fixed, thereby a color image is formed on the recording material.

Figure 1:
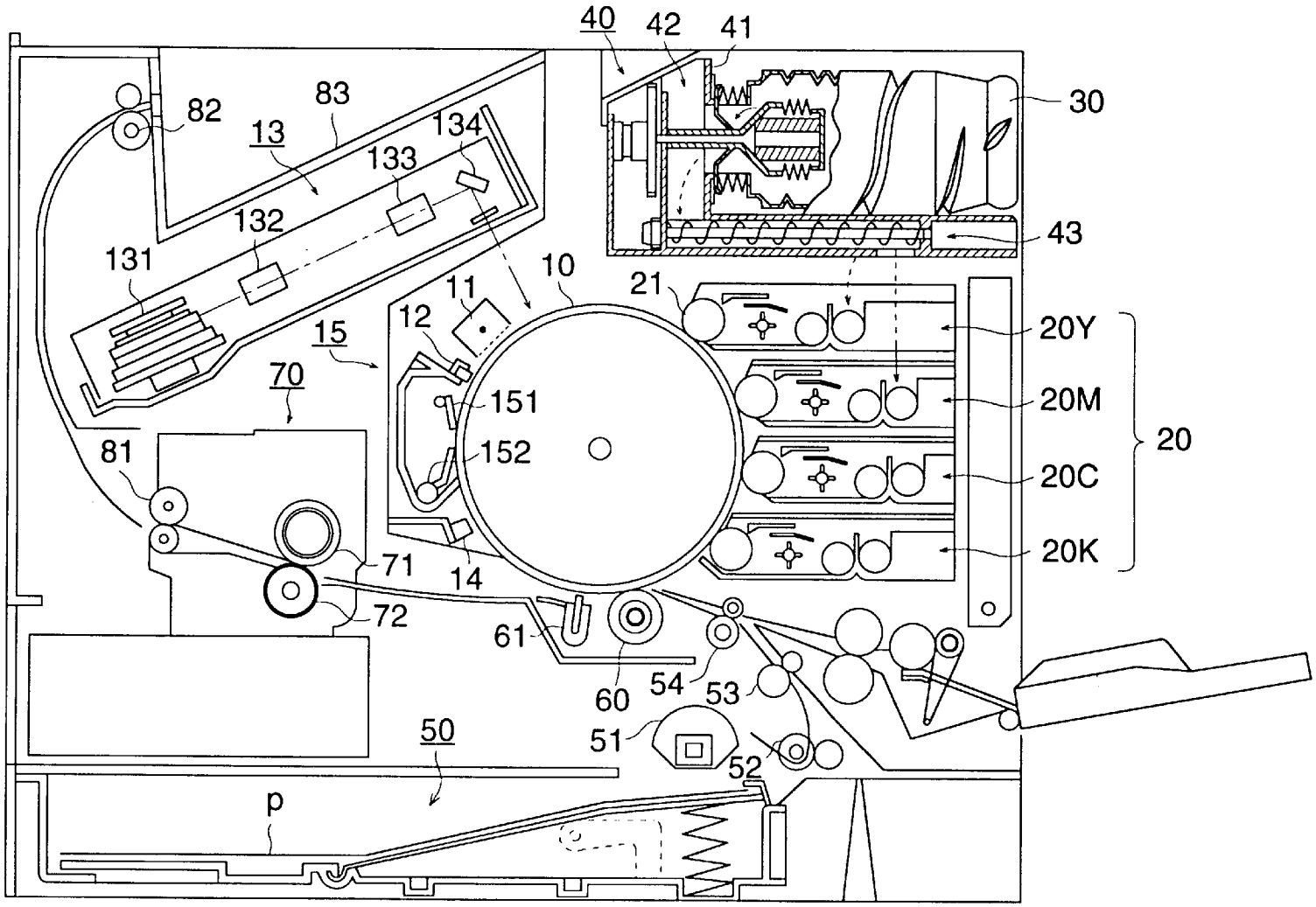
FIG. 1 is a view showing an example of an image forming apparatus in which a toner replenishing apparatus of the present invention is used.

In FIG. 1, numeral 10 is a photoreceptor drum serving as an image forming body in which an OPC photoreceptor (organic photoreceptor) is coated on a drum substrate, and which is electrically grounded and rotated clockwise as shown in the drawing. Numeral 11 is a scorotron charger which is composed of a grid whose potential voltage is held at constant, and a corona discharging wire connected to a high voltage source, and charges the surface of the photoreceptor drum 10 to uniform potential voltage. Prior to the charge by the scorotron charger 11, exposure by a PCL (pre-charging discharger) 12 using light emitting diodes is conducted and the peripheral surface of the photoreceptor is discharged so that hysteresis of the photoreceptor is eliminated.

After uniform charging on the photoreceptor drum 10, image-wise exposure according to an image signal is conducted by an image-wise writing means 13 composed of an image exposing unit. The image-wise writing means 13 conducts scanning exposure by using a reflection mirror 134 through a laser diode, not shown, a rotating polygonal mirror 131, an fθ lens 132, and a cylindrical lens 133. In the present example, an image portion is exposed, and a latent image in which the potential voltage of the image portion is lower than that of non-image portion, is formed.

A developing device 20 composed of developing units 20Y, 20M, 20C and 20K respectively housing therein two-component developer made of toner of yellow (Y), magenta (M), cyan (C), and black (K), and carrier, is provided around the photoreceptor drum 10.

Initially, development by the first color of yellow toner is conducted by a developer carrier (developing sleeve) 21 which houses therein a magnet and is rotated holding the developer. Developer is composed of carrier in which ferrite is used as a core and insulating resin is coated around the core, and toner in which polyester is used as a main material and pigment, charge control agent, silica, and titanium oxide, etc., are added corresponding to the color. Developer is regulated to the developer layer thickness of 100–600 $\mu$m on the developing sleeve 21 by a layer forming means, and conveyed to a developing area.

A gap between the developing sleeve 21 and the photoreceptor drum 10 in the developing area is set to a value larger than the developer layer thickness, for example, 0.2–1.0 mm, and AC bias voltage and DC bias voltage are applied on the gap, wherein the AC bias voltage and DC bias voltage are superimposed. As the DC bias voltage, the bias voltage with the same polarity as toner which develops the latent image, is applied, and toner adheres to a low potential portion of the latent image, and development is conducted. That is, reversal development is conducted.

After the first color development has been completed, the process enters the second color image forming process of magenta, and uniform charging by the scorotron charger 11 is conducted again, and a latent image according to image data of the second color is formed by the image-wise writing means 13. At that time, discharging by the PLC 12 conduced in the first color image formation process is not conducted. After the latent image has been formed, development by magenta toner by a development unit 20M is carried out, and the magenta toner image is formed on the photoreceptor drum 10.

For also the third color of cyan and the fourth color of black, the same image forming process as in the second color of magenta is conducted, and the visual images of four colors of yellow, magenta, cyan and black are formed on the photoreceptor drum 10.

A toner replenishing apparatus 40 to replenish each color toner to the developing units 20Y, 20M, 20C, and 20K, comprises: storing container mounting sections 41Y, 41M, 41C, and 421K in which a plurality of toner storing containers 30Y, 30M, 30C and 30K are detachably mounted respectively; toner storing portions 42Y, 42M, 42C and 42K to temporarily store therein the toner in the toner storing containers 30Y, 30M, 30C and 30K; and toner conveying sections 43Y, 43M, 43C and 43K to convey the toner in the toner storing portions 42Y, 42M, 42C and 42K to the developing units 20Y, 20M, 20C, and 20K.

On the other hand, a sheet of recording material p conveyed from a sheet feed cassette 50 through a semi-circular roller 51, stops once near a registration roller pair 54 through sheet feed roller pairs 52 and 53, and is sent to a transfer area by the rotating operation of the registration roller pair 54 at a point of time well timed with transferring.

In the transfer area, a transfer means 60 is pressure-contacted with the peripheral surface of the photoreceptor drum 10 in timed relationship with transfer timing, the sent recording material p is nipped between them, and a multi-color image is collectively transferred onto the recording material p.

Next, the recording material p is discharged by a separating means 61, separated from the peripheral surface of the photoreceptor drum 10, conveyed to a fixing device 70, and after toner is fused by heat and pressure of a heat roller (upper roller) 71 and a pressure roller (lower roller ) 72, the recording material p is delivered onto a delivery tray 83 provided outside the apparatus through sheet delivery rollers 81 and 82. In this connection, the transfer means 60 is withdrawn and separated from the peripheral surface of the photoreceptor drum 10 after passage of the recording material p, and is ready for the next toner image formation.

On the other hand, after the photoreceptor drum 10, which has passed the transfer and separation position, is subjected to discharging by the discharger 14, the remaining toner thereon is removed by the pressure-contact of a blade 151 of the cleaning device 15, and the photoreceptor drum 10 is cleaned thereby, and is subjected to discharging by the PCL 12 and charging by the scorotron charger 11, and enters the next image forming process. In this connection, the blade 151 is moved at once and withdrawn from the peripheral surface of the photoreceptor drum 10 after cleaning of the photoreceptor surface. The waste toner scraped out by the blade 151 into the cleaning device 15 is delivered by a screw 152, and then, stored in a waste toner collecting container, not shown.

(2) Toner Replenishing Apparatus

Figure 2:
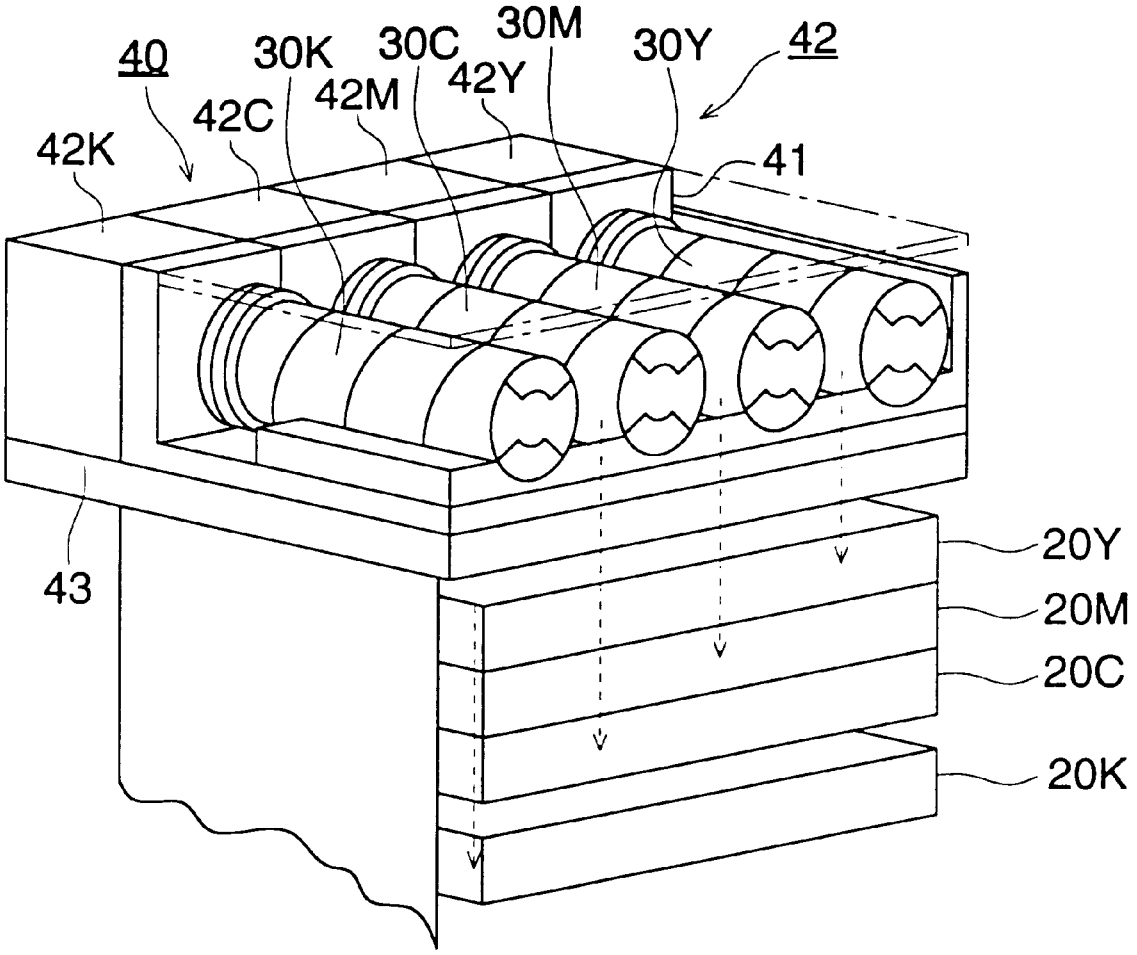
FIG. 2 is a view showing a developing unit and a toner replenishing section of the image forming apparatus shown in FIG. 1.

FIG. 2 is a perspective view showing a part of toner storing containers 30Y, 30M, 30C, and 30K, toner storing portions 42Y, 42M, 42C and 42K, and developing units 20Y, 20M, 20C and 2K. Storing container mounting sections 41Y, 41M, 41C and 41K arrange respective 4 type toner storing containers 30Y, 30M, 30C, and 30K on the almost same surface parallely so as to be detachable. The toner replenishing apparatus is structured such that when an amount of toner in the developing units 20Y, 20M, 20C and 2K is decreased, each toner in the toner storing containers 30Y, 30M, 30C, and 30K is replenished at a controlled rate. These toner storing containers 30Y, 30M, 30C, and 30K have the almost same structure, therefore, hereinafter, these toner storing containers 30Y, 30M, 30C, and 30K are represented by and referred to as the toner storing container 30, which will be described below.

Figure 3:
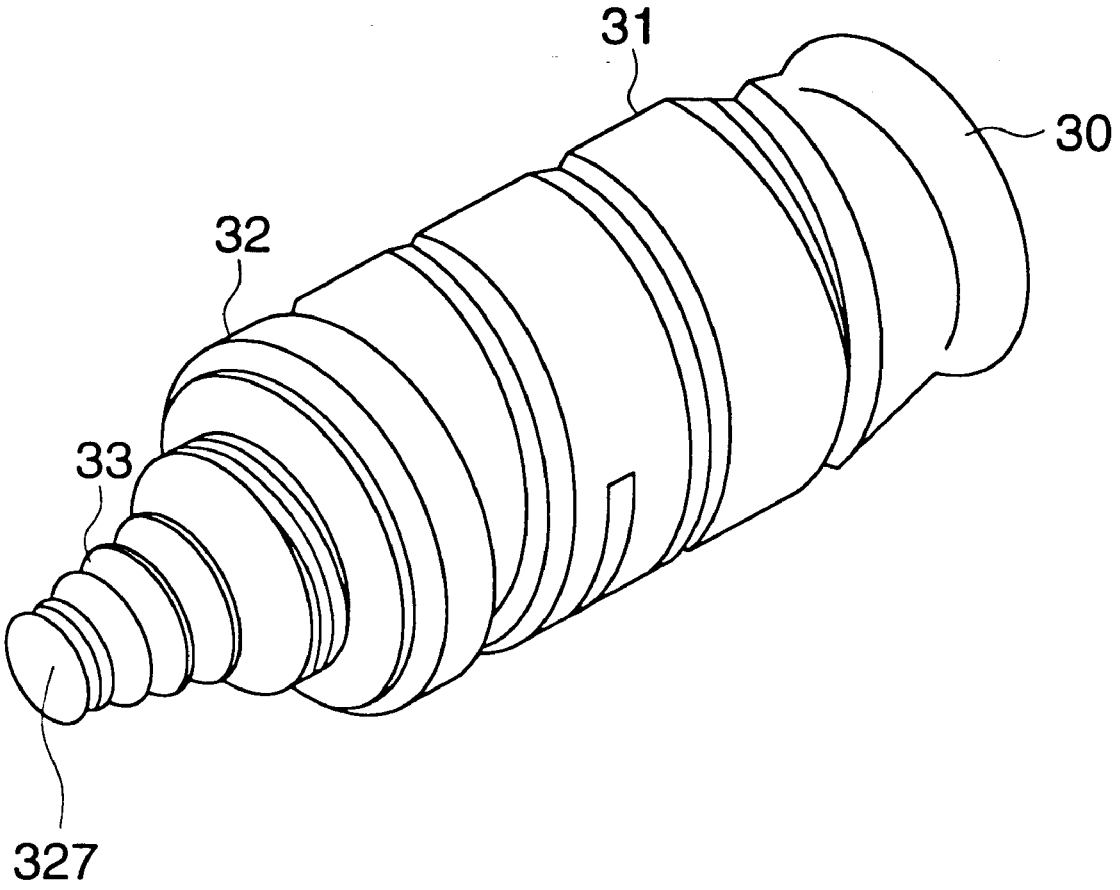
FIG. 3 is a perspective view of a toner storing container used in the image forming apparatus shown in FIG. 1.

The toner storing container 30 is cylindrical as shown in FIG. 3, and a spiral protrusion protruded on the inner peripheral surface in the cylindrical portion, is formed in a cylindrical portion as shown by numeral 31. The protrusion 31, as will be described later, moves the stored toner T from a container bottom portion, that is, from right upper portion in FIG. 3 to a container mouth portion, that is, to the right lower portion by the rotation of the toner storing container 30. A detachable solid lid 32 and a flexible lid 33, which is telescopic in the direction of the cylinder axis, are provided on the mouth portion of the toner storing container 30.

Figure 4:
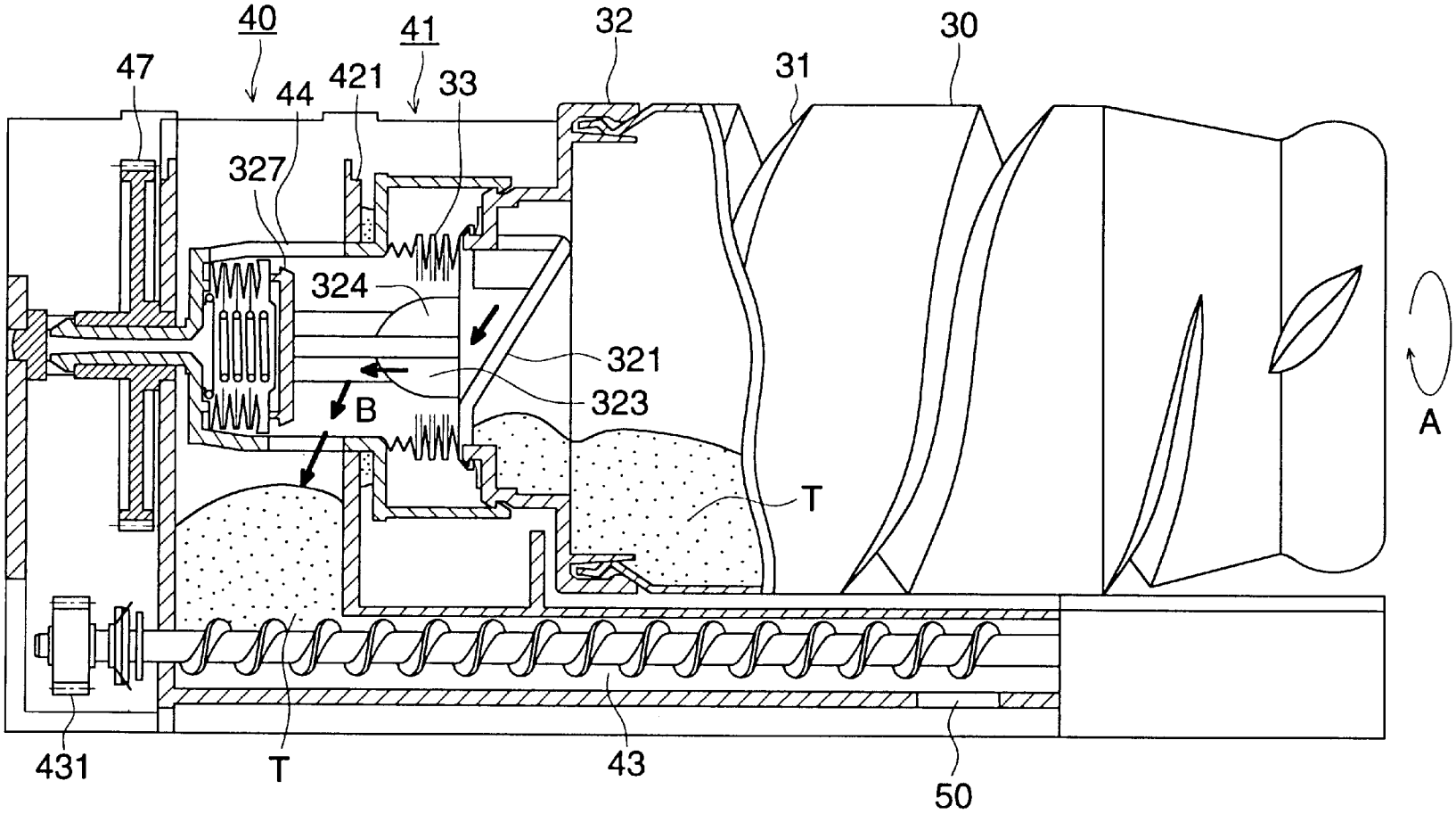
FIG. 4 is a front view (partially showing a section) of the toner replenishing apparatus according to the example of the present invention.

FIG. 4 shows a state in which the toner storing container 30 is mounted in the toner replenishing apparatus. The toner storing container 30 is mounted in such a manner that a screw provided on the outer periphery of the solid lid 32 is screwed into a container receiving member 44 of the image forming apparatus main body. In this mounting state, the flexible lid 33 of the toner storing container 30 is brought into contact with a wall portion 421 provided in the container receiving member 44 of the apparatus main body, compressed as shown in the drawing, and an opening through which toner can pass, is formed between the flexible lid 33 and a top lid 327 forming a portion of the solid lid 32. In this connection, as shown in FIG. 3, in the state in which the toner storing container 30 is not mounted in the image forming apparatus, the flexible lid 33 is in close contact with the top lid 327 by the spring force of the lid 33 itself, and thereby, toner does not flow out of the toner storing container 30.

Next, a toner replenishing mechanism will be described.

Figure 5:
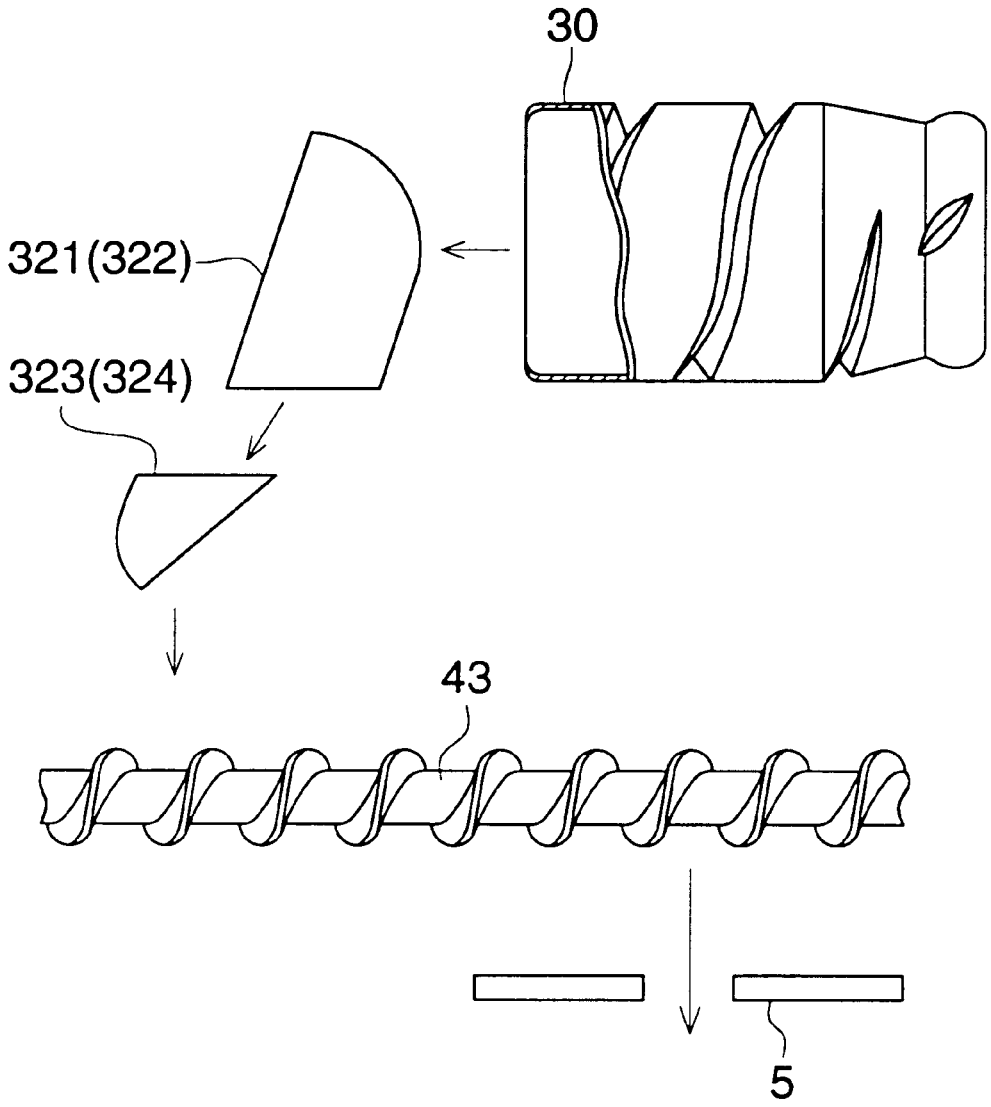
FIG. 5 is a view showing a movement path of toner in the toner replenishing apparatus shown in FIG. 4.

The toner T in the toner storing container 30 is moved from the right to the left in the drawing along the bottom of the cylindrical portion of the toner storing container 30 by the feeding action of the protrusion 31 when the toner storing container 30 is rotated. The toner T is scraped out by scraping members 321 and 322 provided on the solid lid 32, at a mouth portion of the toner storing container 30, that is, the right end portion. The scraped-out toner T slides down on the conveying slopes 323 and 324, falls on a conveying screw 43, and the toner T is conveyed by the conveying screw 43, and is supplied from an opening 50 to developing units 20Y, 20M, 20C and 20K, (hereinafter, these are represented by and referred to as the developing unit 20). That is, as shown in FIG. 5, the toner T is supplied to the developing unit 20 through a path; the toner storing container 30→scraping members 321, 322→conveying slopes 323, 324→the conveying screw 43→the opening 50.

The scraping-out operation of scraping members 321 and 322 will be described below.

Members to scrape out the toner from the toner storing container are provided on the solid lid 32.

Figure 6:
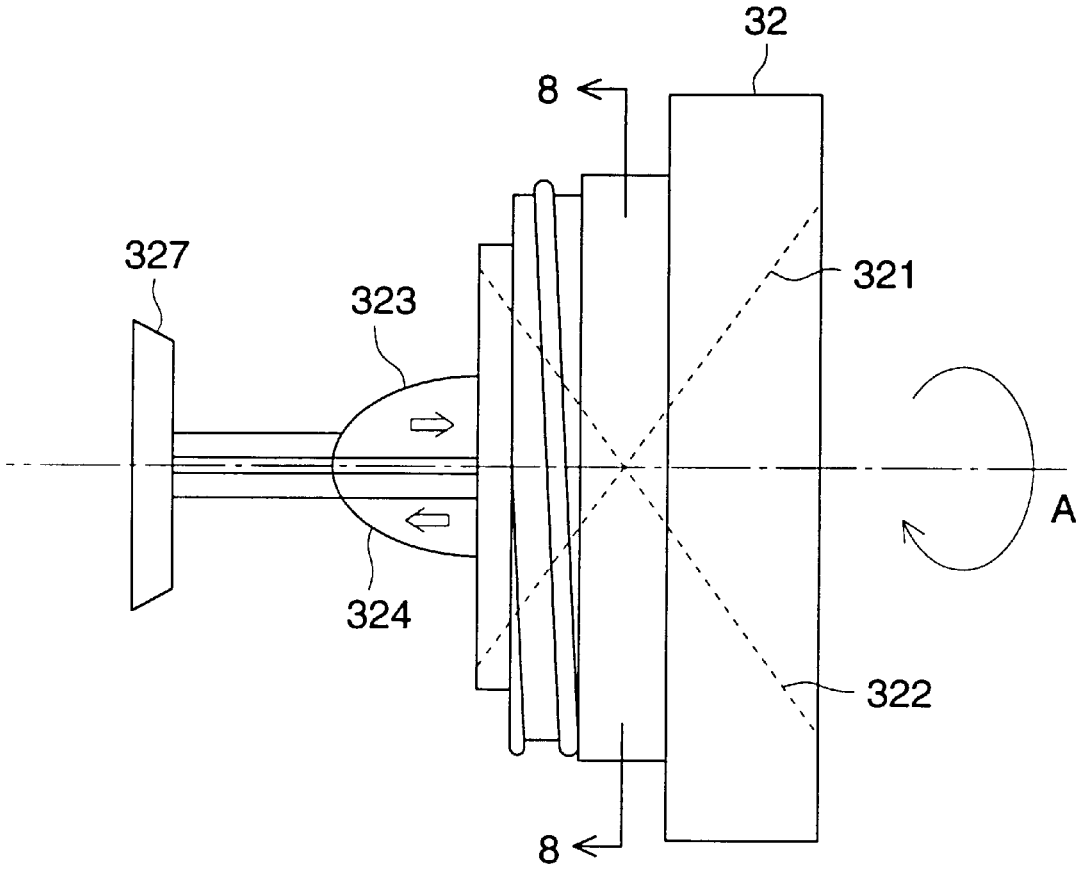
FIG. 6 is a front view of a solid lid of the toner storing container of the toner replenishing apparatus shown in FIG. 4.

FIG. 6 is a front view of the solid lid 32 from which the flexible lid 33 is removed, and which is structured by scraping members 321 and 322 provided on the cylindrical lid base body, conveying slopes 323 and 324, and the top lid 327.

Figure 9:
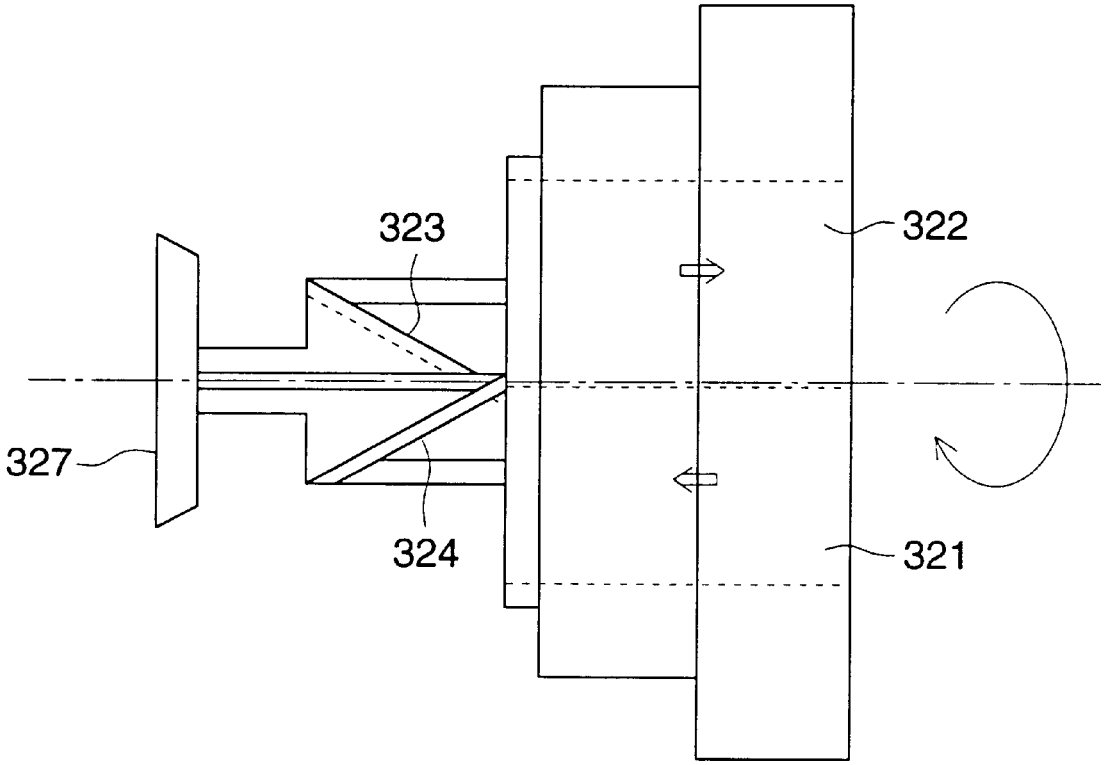
FIG. 9 is a view showing a state in which the solid lid shown in FIG. 6 is rotated by 90°.

As shown in FIG. 6, the scraping members 321 and 322 have slanting surfaces which are respectively inclined in the opposing directions. As shown in FIG. 6 and FIG. 9 in which the solid lid 32 is rotated by 90° from the position shown in FIG. 6, in the rotational direction shown by A, conveying slopes 323 and 324 are provided in such a manner that phases of the slopes 323 and 324 are shifted by 90° with respect to the slanting surfaces of the scraping members 321 and 322 in the rotational direction A of the solid lid 32. In FIGS. 6 and 9, the white arrow shows the direction of the inclination of the slanting surface, and the direction of the arrow shows the direction lowering perpendicularly to the drawing. An opening, not shown, through which the toner passes, is formed between the scraping members 321, 322, and the conveying slopes 323 and 324.

Figure 7:
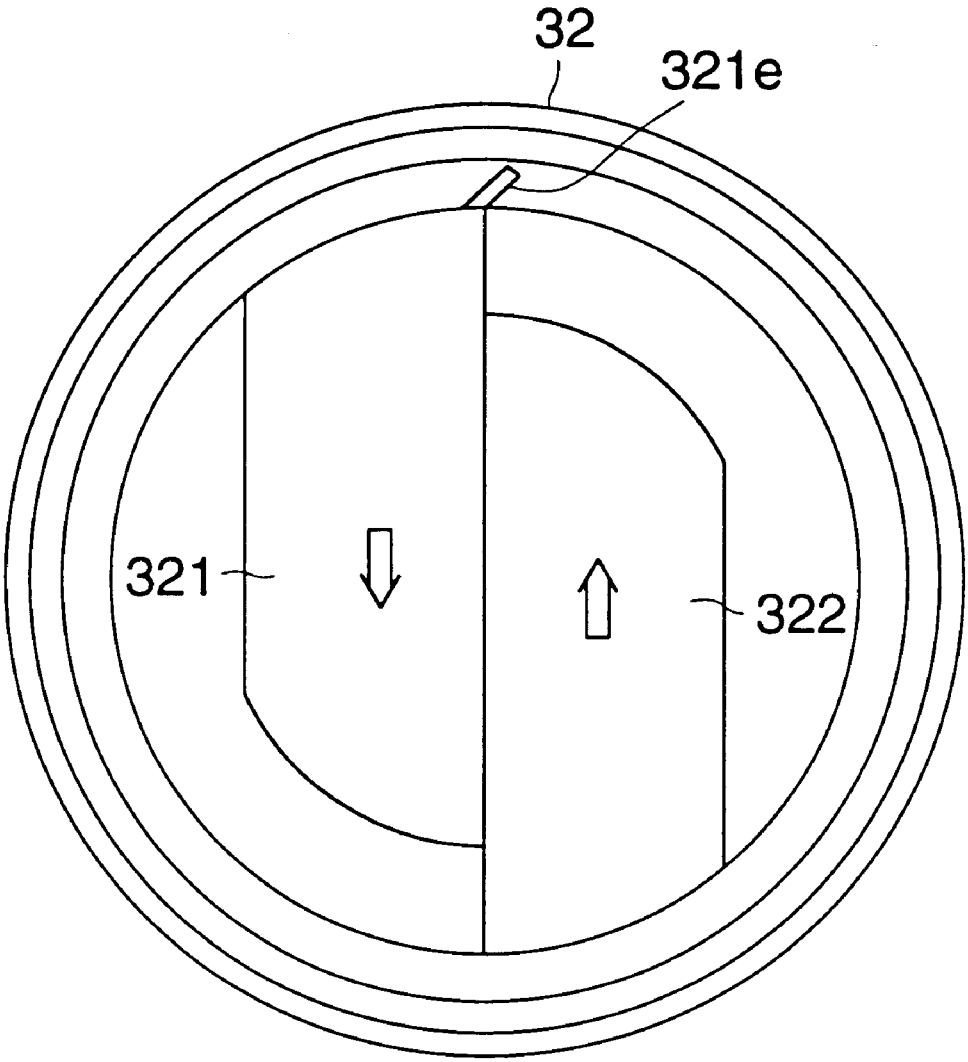
FIG. 7 is a right-side view of the solid lid shown in FIG. 6.
Figure 8:
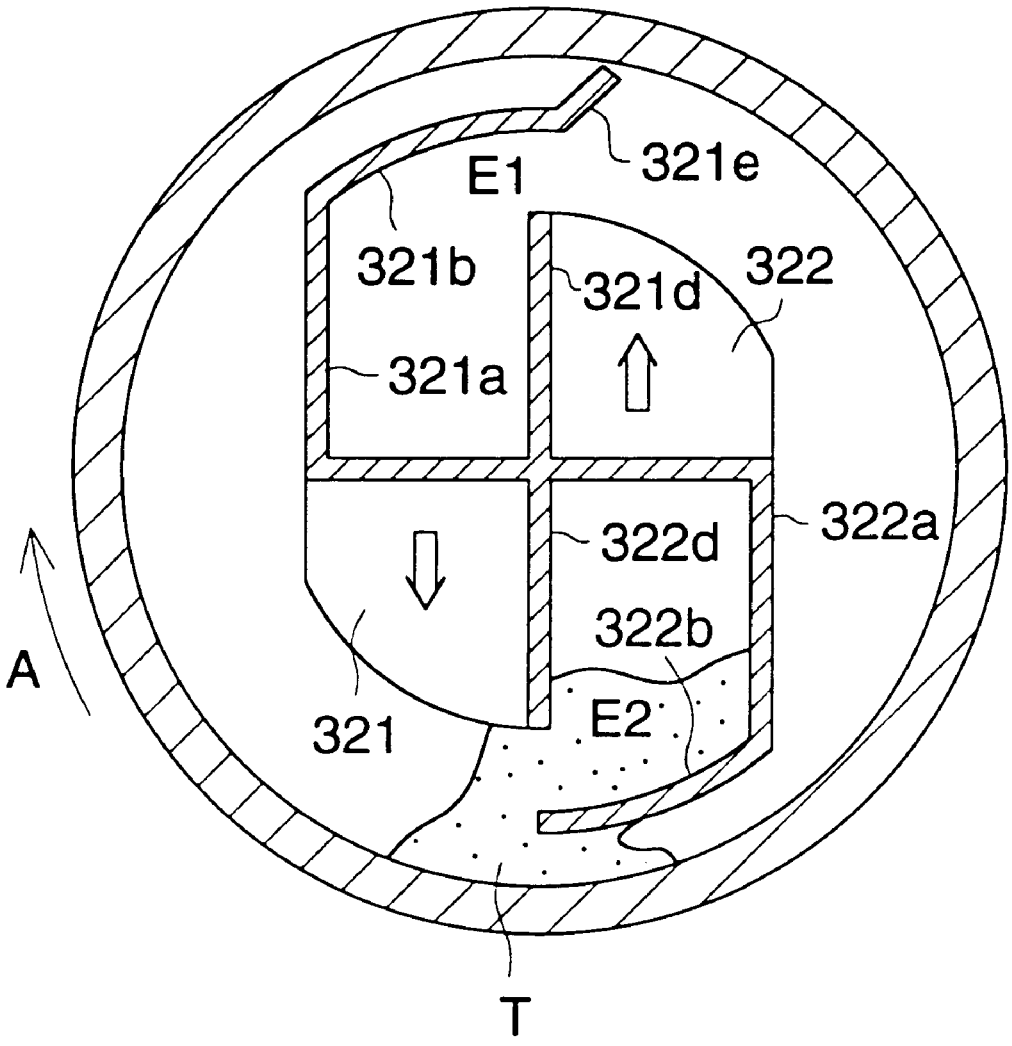
FIG. 8 is a sectional view taken on line 8—8 in FIG. 6.

FIG. 7 is a right side view of the solid lid 32 shown in FIG. 6. As shown in FIG. 7, the solid lid 32 is provided with scraping members 321 and 322 symmetrically around the rotational axis of the toner storing container 30, and these slanting surfaces are divided into two portions respectively inclined in the opposing directions as shown in FIG. 7 (the white arrow shows the direction of inclination of the scraping member, and the direction of the arrow shows the direction in which the inclination lowers). As shown FIG. 8 which is a sectional view along the 8—8 line in FIG. 6, the scraping member 321 forms a toner holding space E1 to hold the toner, by a side wall 321*a*, a circular blade 321*b* extending in the circumferential direction, and a central wall 321*d*, together with its slanting surface. In the same manner, the scraping member 322 forms a toner holding space Eddy by the slanting surface of the member itself, a side wall 322*a*, a circular blade 322*b* and a central wall 322*d*. When the toner storing container 30 is rotated, the solid lid 32 is rotated as shown by an arrow A, and the toner T is scooped up by the circular blade 322*b*, as shown in FIG. 8, and held in the toner holding space Eddy, and is conveyed.

The conveying operation of the toner T scraped out by the scraping members 321 and 322, to the conveying screw 43 will be described below.

FIG. 9 shows a state in which the solid lid 32 is rotated by 90° from the state shown in FIG. 6. As can clearly be seen from FIGS. 6 and 9, phases of conveying slopes 323 and 324 are respectively shifted by 90° with respect to scraping members 321 and 322. The conveying slopes 323 and 324 are inclined in opposite directions to each other.

A receiving member 44 for receiving the solid lid 32 of the toner storing container 30 is rotatably provided in the image forming apparatus main body, and fixed to a gear 47. When the gear 47 is driven by a motor, not shown, the receiving member 44 and the toner storing container 30 are rotated as shown by an arrow A, and the solid lid 32 is rotated in the same manner.

By this rotation, the toner T, scooped up by the circular blade 321*a* of the scraping member 321 and held in the holding space E1, falls on the slanting surface at the rotational position at which the scraping member 321 forms a slanting surface lowering to the left direction, as shown in FIG. 4, and falls onto the conveying slope 323. In the same manner, the toner T scraped out by the scraping member 322 falls onto the conveying slope 324.

As shown in FIG. 9, the conveying slope 323 is formed in such a manner that its phase is behind that of the scraping member 321 by 90° and it forms a slope lowering to the left, and receives the toner T fallen from the scraping member 321, and conveys the toner T onto the conveying screw 43. In the same manner, the conveying slope 324 receives the toner T fallen from the scraping member 322 and conveys it onto the conveying screw 43.

As described above, the toner T is moved on a movement path from the toner storing container 30 to the conveying screw 43 as shown by an arrow B in FIG. 4.

The conveying screw 43 is driven by the gear 431 driven by a motor, not shown, and conveys the toner T from the left to the right in FIG. 4, and conveys it to an opening 50 which is a supplying section to the developing unit 20. The developing unit is provided with a toner density detecting device to detect the toner density of the developer, for example, from permeability of the developer, and the toner replenishment is conducted by rotations of the toner storing container 30, the solid lid 32, and the conveying screw 43 according to a signal from the toner density detecting device. The scraping member 321 and the scraping member 322 are structured such that the scraping capacity of these members is different from each other.

As shown in FIG. 8, in the scraping member 321, a top blade 321*e* is provided on the top of the circular blade 321*b*. In contrast to this, a top blade is not provided on the top of the circular blade 322*b* of the scraping member 322. The distance between the scraping member 321 and the inner peripheral surface of the solid lid 32 is formed such that the distance is narrower than that between the scraping member 322 and the inner peripheral surface of the solid lid 32, by providing the top blade 321*e*. Accordingly, the scraping member 321 can scoop up toner until a remaining amount of the toner in the toner storing container 30 is more decreased than that in the case of the scraping member 322. That is, the raking member 321 and the scraping member 322 are structured such that the scraping capacity of them is different from each other.

By such the structures of scraping members 321 and 322, when the remaining amount of toner in the toner storing container 30 is decreased, the conveying amount or the conveying rate is not quickly lowered, but gradually decreased.

Figure 13:
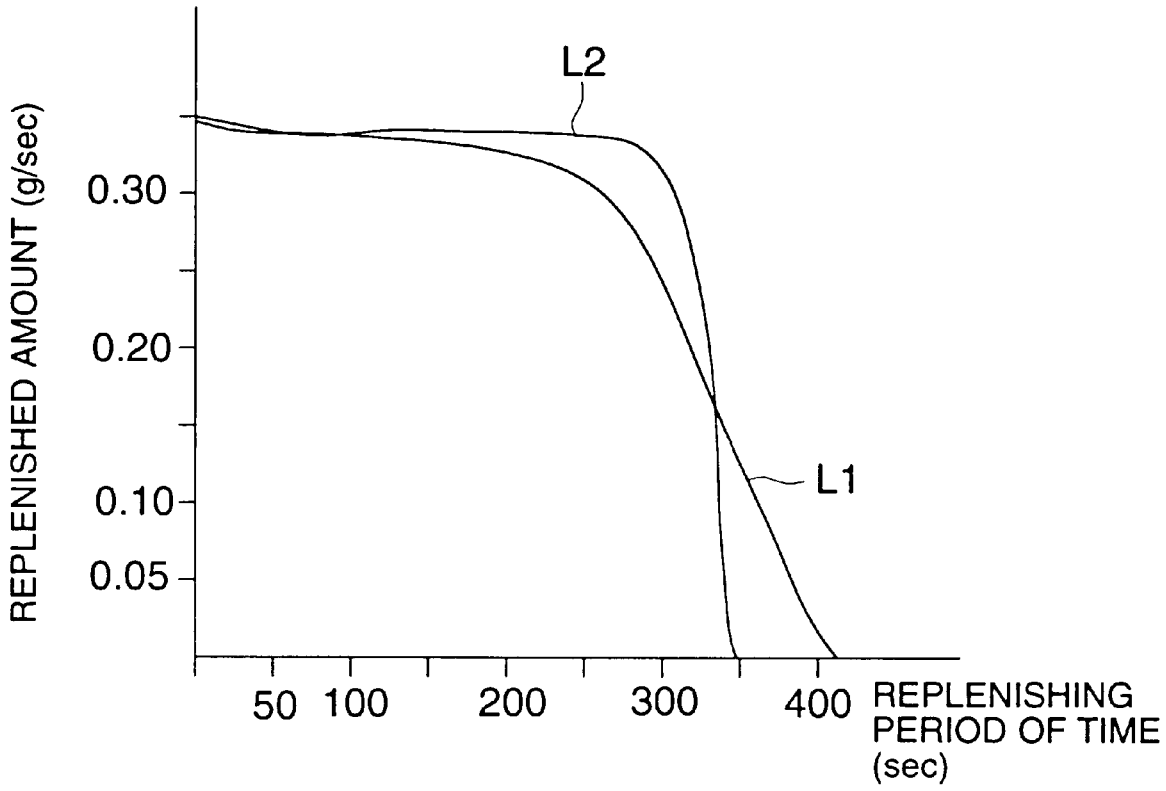
FIG. 13 is a view showing an aging change of a toner replenishing rate of the toner replenishing apparatus.

FIG. 13 shows an aging change of the replenishing amount of toner of the toner replenishing apparatus shown in FIG. 4. In FIG. 13, a curve L1 shows an aging change of the replenishing amount of toner of the toner replenishing apparatus shown in FIG. 4. A curve L2 shows an aging change of the replenishing amount of toner of the toner replenishing apparatus structured such that the top blade 321*e* is not provided on the scraping member 321, and the shape of the scraping members 321 and 322 is the same, and these members have the same scraping capacity. As can clearly be seen from the drawing, in the toner replenishing apparatus shown in FIG. 4, when the remaining amount of toner in the toner storing container 30 is decreased, the replenishing amount of toner or the toner replenishing rate is gradually decreased.

(3) Remaining Toner Amount Detection

Figure 10:
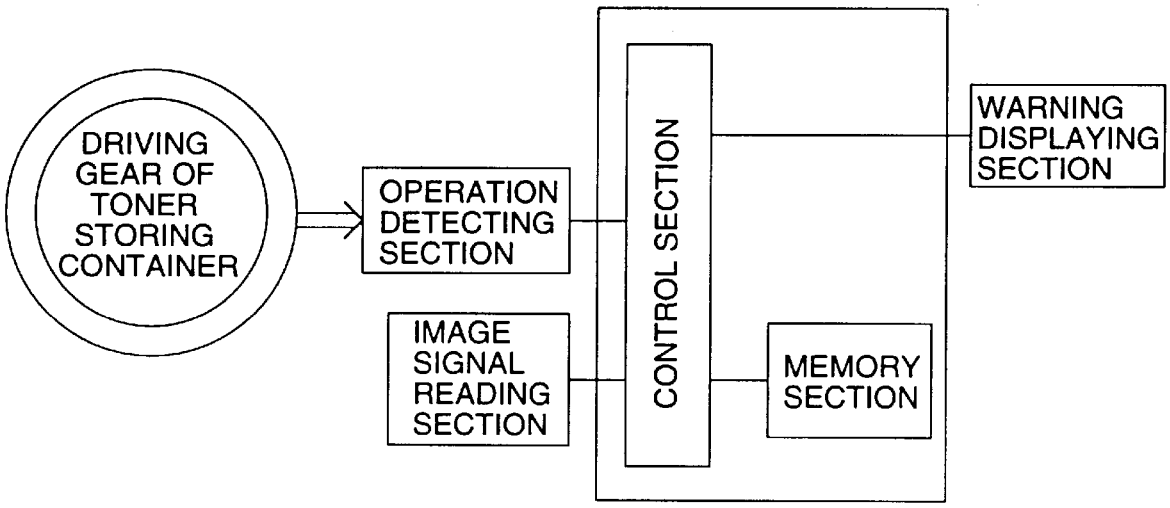
FIG. 10 is a block diagram of a remaining toner amount detecting device used in the toner replenishing apparatus shown in FIG. 4.

FIG. 10 is a block diagram showing a remaining toner amount detecting device used in the toner replenishing apparatus shown in FIG. 4. An operation detecting section is an operation detecting means for detecting operations of the toner replenishing means to replenish the toner to the developing unit. When the developing unit is one which uses two-component developer, the toner replenishing operation is conducted according to a signal outputted when the toner density detecting device in the developer detects that the developer density in the developing unit is lowered. When the developing unit is one which uses one-component developer, the toner supplying operation is conducted according to a signal showing that the amount of the developer in the developing unit is insufficient. In the present example, toner replenishment is conducted by the rotation of the toner storing container 30 and the screw 43. The operation detecting means detects the replenishing operation of the replenishing apparatus, and in the present example, detects the rotation of the toner storing container 30. Concretely, an encoder is provided on the driving gear of the toner storing container 30, and the rotation of the encoder is detected by a sensor.

The image forming apparatus to which the present invention is applied, is an image recording apparatus to conduct image recording according to an image signal, and the image signal includes an image signal obtained by reading and processing the document image, an image signal produced by the inputting operation, or an image signal made of transmitted data. An image signal detecting means is an image signal reading section to detect existence or on-existence of the image signal, and is a circuit to generate an input signal to the control section, corresponding to an image signal to the recording section of the image recording apparatus. Concretely, such sampling circuit is used that the image signal to the recording section is sampled by a clock having a predetermined frequency.

As will be described later, in the present example, an amount of image is totalized, however, the image reading section may be one which outputs a signal corresponding to the pulse carrying image data. When the image signal is a binary signal, the image reading section may be a counter to count the image signal.

Figure 11:
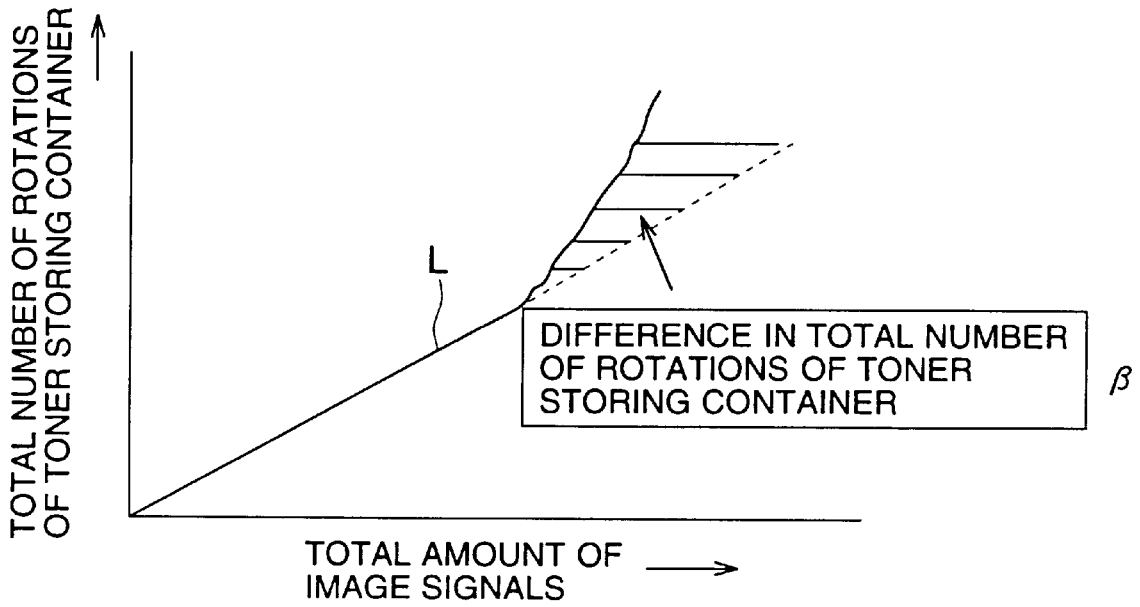
FIG. 11 is a graph explaining remaining toner amount detection of the remaining toner amount detecting device shown in FIG. 10.

The control section and a memory section have calculation means by which respective signals from the toner replenishing operation detecting means and the image signal detecting means are totalized, and totalized values are respectively compared. Referring to FIG. 11, this totalization and comparison will be described below.

In FIG. 11, the axis of abscissas and the axis of ordinates are respectively a total amount of image signals and an amount of operations of the toner replenishing apparatus. The total value of the image signal is an amount of image signals. Concretely, the amount of operations is a total number of rotations of the toner storing container 30. Theoretically, an amount of image signals and an amount of operations of the toner replenishing means have a proportional relationship, that is, a linear relationship. That is, a consumed amount of toner is proportional to a total amount of image signals, and an amount of operations of the toner replenishing means (a total number of rotations of the toner storing container 30) is proportional to a consumed amount of toner. A linear portion of the curve L in the drawing shows such the proportional relationship. However, when an amount of toner in the toner storing portion, that is, an amount of toner in the toner storing container 30 is decreased, and the toner conveying efficiency of the toner replenishing means is decreased, this proportional relationship is lost. As the result of that, as shown by the right end portion of the line L, a relationship of this correspondence is not shown by a linear line, but shown by a curve.

The present example is structured by aiming at such the relationship between an amount of image signals and an amount of operations of the toner replenishing means, and a judging system to judge that an amount of toner in the toner storing section is insufficient when such the relationship comes off the linear line, is made, thereby, the toner replenishment such as the replacement of the toner storing container can be securely conducted.

Figure 12:
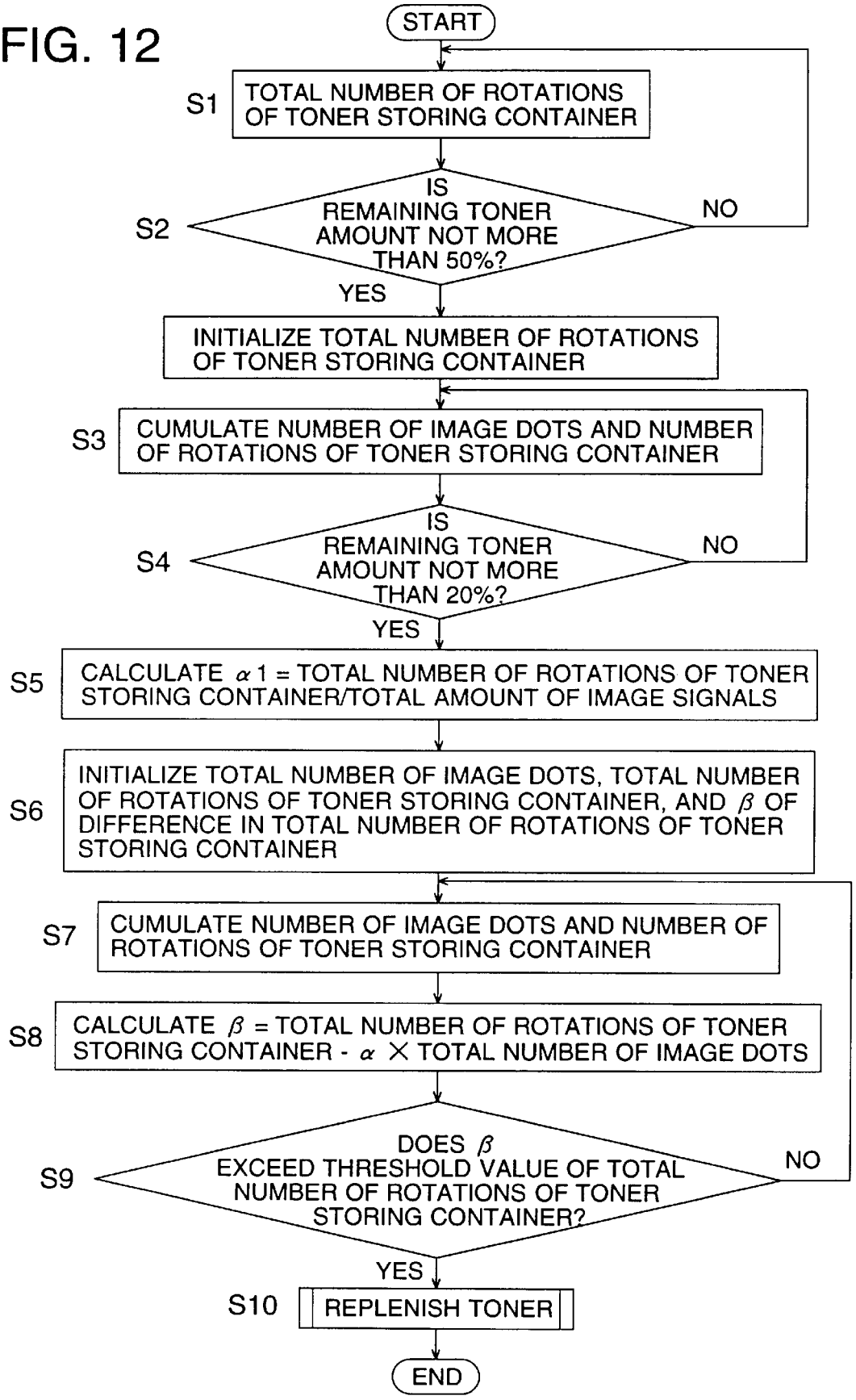
FIG. 12 is a flow chart of a control program of the remaining toner amount detecting device shown in FIG. 10.

Next, referring to FIG. 12, operations of a toner replenishment judging system will be described.

An amount of operations of the toner replenishing means is totalized in step S1. The totalization is one from the point of time when the toner storing container 30 is replaced, and toner in the toner storing section, that is, toner in the toner storing container 30 is full, that is to say, the toner storing container 30 is in an initial condition. Accordingly, from this totalized value, an amount of toner consumption, in other word, a remaining toner amount in the toner storing section is measured from the totalization in this step. In step S2, it is judged whether the remaining toner amount measured from the above cited totalized value is not more than 50% or not. When the remaining toner amount is not more than 50%, totalization of the number of rotations of the toner storing container 30 and totalization of image signals are conducted (step S3). This totalization is continued until the remaining toner amount in the toner storing section is not more than 20% (step S4). When the remaining toner amount is not more than 20%, the amount of operations/the amount of image signals=$\alpha 1$ is calculated (step S5). The calculation of $\alpha 1$ is the calculation to check a ratio of the amount of toner replenishing operations to the amount of image signals in the state in which the remaining toner amount in the toner storing section is sufficient. That is, the process up to step S5 is one to check the inclination of a linear line portion of the line L in FIG. 11. In step S6, the amount of toner replenishing operations, the amount of image signals, and $\beta$ (will be described later), are initialized. Then, totalization of the amount of toner replenishing operations and the amount of image signals is started again (step S7), and the following is calculated (step S8): $\beta$=the amount of operations$-\alpha\times$the amount of image signals. This calculation is a calculation of the difference shown by hatching in FIG. 11. Next, it is judged whether $\beta$ exceeds a threshold value or not (step S9), and when $\beta$ exceeds a threshold value, a toner replenishing signal is outputted (step S10).

According to this toner replenishing signal, a warning displaying section (warning means) for toner replenishment is operated, and warns the operator to replenish the toner. As a mode of toner replenishment warning, there are following modes: a mode in which a toner replenishment warning is outputted only by the first time toner replenishing signal; a mode in which initially, as an initial warning, a warning that the remaining toner amount is few, is outputted, and on the next stage, the toner replenishment warning is outputted and the operation of the image forming apparatus is stopped; or a mode in which a preparatory warning is outputted as the initial warning, and following to that, the toner replenishment warning is outputted and only a predetermined number of printing sheets is allowed to be printed, and a printing amount more than a predetermined value is prohibited, or similar mode, and the warning means is designed such that the toner replenishment warning appropriate for the use of the image forming apparatus, is outputted.

The developing performance of the developing unit is not always constant. Specifically, in the case of two-component developing type, the relationship between the toner density in the developer and the developing density (image density) is changed by exhaustion of the developer. Accordingly, in some case, an amount of operations of the toner replenishing means to an amount of image signals is increased, and the toner density of the developer in the developing unit is increased, thereby, a desired image density is obtained. In such the case, the above cited ratio $\alpha 1$ is changed. Accordingly, in such the case, correction is made in the step in which totalization or calculation of the ratio is made in FIG. 12. By this correction, the remaining amount of toner in the toner storing means is accurately measured.

In this connection, although not shown in the drawing, when a new toner storing container is mounted and new toner is replenished, the amount of operations, the amount of image signals, and the ratio which are stored in the memory section, are cancelled and initialized by receiving the signal of this new toner replenishment. Further, as a countermeasure in the case where the relationship between the amount of operations and the amount of image signals becomes abnormal due to a failure of the apparatus, or the like, an abnormality detecting means is provided in the control section.

The remaining toner amount detecting device which is shown in FIG. 10 and described above, detects that remaining toner amount is few, from the occurrence of change in the toner replenishing rate. In the toner replenishing apparatus provided with such the remaining toner amount detecting device, when the toner replenishing amount is quickly reduced, as shown by the curve L2 in FIG. 13, a signal (toner replenishing signal) showing that the remaining toner amount is few is outputted, and soon, the replenishment of toner becomes zero.

From the point of view of easiness in use, or the like, such the operations are not desirable, and it is preferable that the toner replenishment is continued for a while after the toner replenishing signal is outputted, and images can be formed.

From such the practical point of view, the toner replenishing apparatus according to the present example is specifically effective when it is used for the toner replenishing apparatus provided with the remaining toner amount detecting device shown in FIG. 10.

Further, in the toner replenishing characteristic like as the curve L2 shown in FIG. 13, the remaining toner amount is fluctuated when the remaining toner amount detecting device is operated, that is, operations of the remaining toner amount detecting device become unstable, however, when it is made to coincide with the toner replenishing characteristic shown by the curve L1, the operation of the remaining toner amount detecting device becomes stable.

Example of the present invention is described above, however, the present invention is not limited to the present example, but various modification are possible. For example, as the scraping means, a screw, by the rotation of which toner is scraped out and conveyed, may be used, and the toner storing section is not structured by the toner storing container, but may be provided in the image forming apparatus main body.

According to the present invention, it is prevented that the toner replenishing rate is quickly decreased from the steady state, and the remaining toner amount becomes zero. Thereby, the toner replenishing rate is gradually decreased from the steady state, and therefore, the image formation can be continued without lowering the image quality even after the remaining toner amount is few. Accordingly, the present invention is practical and can stabilize the operation of the remaining toner amount detecting device.

What is claimed is:

1. A toner replenishing apparatus for replenishing toner to a developing device in an image forming apparatus comprising (a) a toner reservoir section for holding reserved toner therein;

(b) a scraper element, having at least a first scraping member and a second scraping member which advance said reserved toner from said toner reservoir section toward said developing device, said first scraping member advancing said reserved toner at a greater rate than said second scraping member, said first scraping member extending radially closer to an internal circumference of said toner replenishing device than does said second scraping member, said first scraping member having a top blade at its radial extreme, said top blade being absent from said second scraping member.

2. The toner replenishing apparatus of claim 1 wherein said first scraping member advances said reserved toner at a greater rate than said second scraping member after a remaining amount of said reserved toner in said toner reservoir section falls below a predetermined minimum.

3. The toner replenishing apparatus of claim 1 wherein said first scraping member and said second scraping member each contain a toner holding space.

4. A toner replenishing apparatus for replenishing toner to a developing device in an image forming apparatus comprising (a) a toner reservoir section for holding reserved toner therein;

(b) a scraper element, having at least a first scraping member and a second scraping member which advance said reserved toner from said toner reservoir section toward said developing device, said first scraping member advancing said reserved toner at a greater rate than said second scraping member, said toner reservoir section including a toner storing container attachable to said replenishing apparatus; said toner storing container being rotatably attachable and detachable to and from the replenishing apparatus, each of said first scraping member and said second scraping member scraping out said reserved toner from said toner reservoir section when said toner storing container rotates.

5. A toner replenishing apparatus for replenishing toner to a developing device in an image forming apparatus comprising (a) a toner reservoir section for holding reserved toner therein;

(b) a scraper element, having at least a first scraping member and a second scraping member which advance said reserved toner from said toner reservoir section toward said developing device, said first scraping member advancing said reserved toner at a greater rate than said second scraping member, a detecting device for detecting a remaining amount of said reserved toner being in said toner reservoir section; said detecting device comprising a calculator for comparing a total amount of toner replenishment of said toner replenishing apparatus to a total amount of image signals generated by said image forming apparatus.

* * * * *